US007226532B2

(12) United States Patent
Whitmore

(10) Patent No.: US 7,226,532 B2
(45) Date of Patent: Jun. 5, 2007

(54) CATHODIC PROTECTION OF STEEL WITHIN A COVERING MATERIAL

(76) Inventor: David W. Whitmore, 38 Kings Drive, Winnipeg, Manitoba (CA) R3T 3E5

( * ) Notice: Subject to any disclaimer, the term of this patent is extended or adjusted under 35 U.S.C. 154(b) by 388 days.

(21) Appl. No.: 10/683,108

(22) Filed: Oct. 14, 2003

(65) Prior Publication Data

US 2005/0077191 A1 Apr. 14, 2005

(51) Int. Cl.
*C23F 13/10* (2006.01)

(52) U.S. Cl. ..... 205/734; 204/196.36; 204/196.37; 204/196.18; 204/196.19; 204/196.23; 204/196.24; 204/196.25

(58) Field of Classification Search ..... 205/734; 204/196.36, 196.37, 196.18, 196.19, 196.23, 204/196.24, 196.25
See application file for complete search history.

(56) References Cited

U.S. PATENT DOCUMENTS

| | | | | |
|---|---|---|---|---|
| 5,055,166 | A | 10/1991 | Schutt | |
| 5,714,045 | A | 2/1998 | Lasa et al. | |
| 5,968,339 | A * | 10/1999 | Clear | 205/730 |
| 6,193,857 | B1 | 2/2001 | Davison et al. | |
| 6,383,364 | B1 | 5/2002 | Austnes | |

FOREIGN PATENT DOCUMENTS

| | | |
|---|---|---|
| WO | WO 94/29496 | 12/1994 |
| WO | WO 00/46422 | 8/2000 |
| WO | WO 03/010358 A2 | 2/2003 |
| WO | WO 03/027356 A1 | 4/2003 |
| WO | WO 03/050325 A2 | 6/2003 |

* cited by examiner

*Primary Examiner*—Bruce F. Bell
(74) *Attorney, Agent, or Firm*—Adrian D. Battison; Michael R. Williams; Ryan W. Dupuis

(57) ABSTRACT

Cathodic protection of an existing concrete structure, including a steel member at least partly buried, such as steel rebar, in the concrete structure, is provided by embedding anodes into a fresh concrete layer applied over an excavated patch and/or as a covering overlay. The anodes are embedded at spaced positions or as an array in the layer and connected to the rebar. A reinforcing layer is applied to the anode or adjacent the anode to resist expansion of the anode body tending to cause cracking of the concrete caused by the larger volume of the corrosion products relative to the anode material. Pores are provided in the anode body so as to take up the corrosion products. The reinforcing layer can be provided in the actual anode body as a closed surface surrounding the anode material inside or may be provided in the concrete as a layer on top of the anode in an array form at or near the outer surface of the concrete.

25 Claims, 5 Drawing Sheets

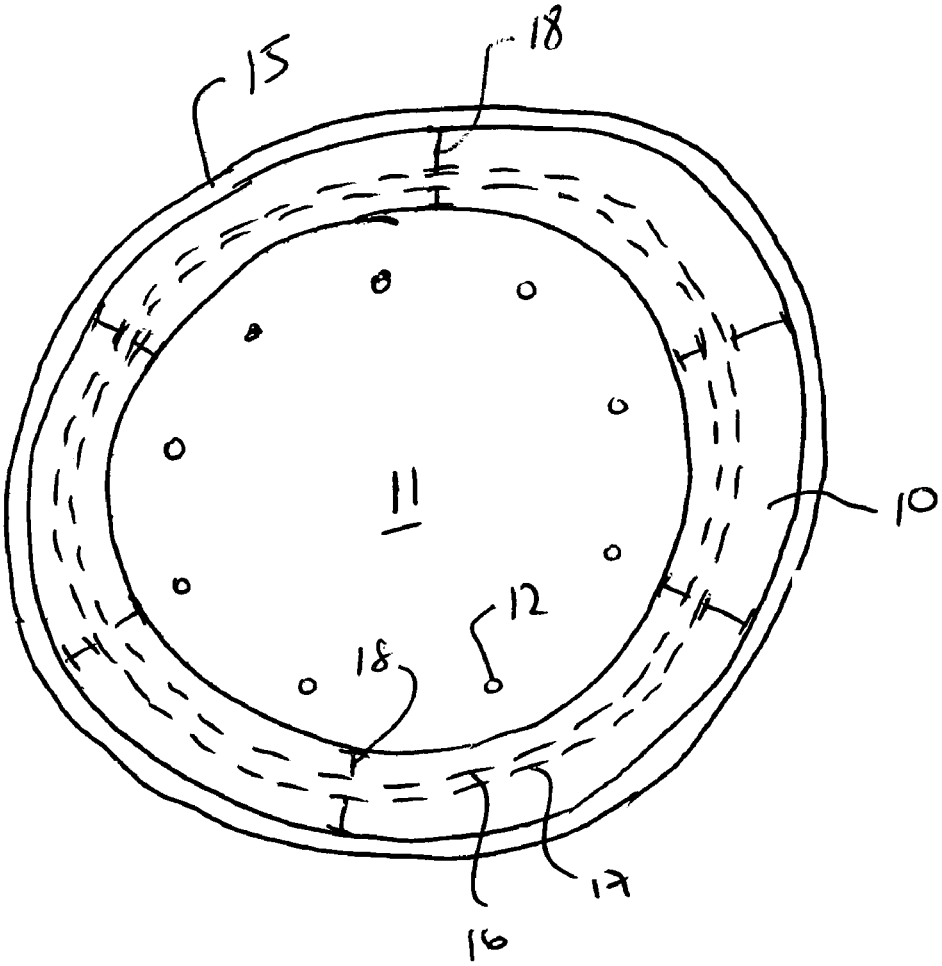
FIG. 2
FIG. 3
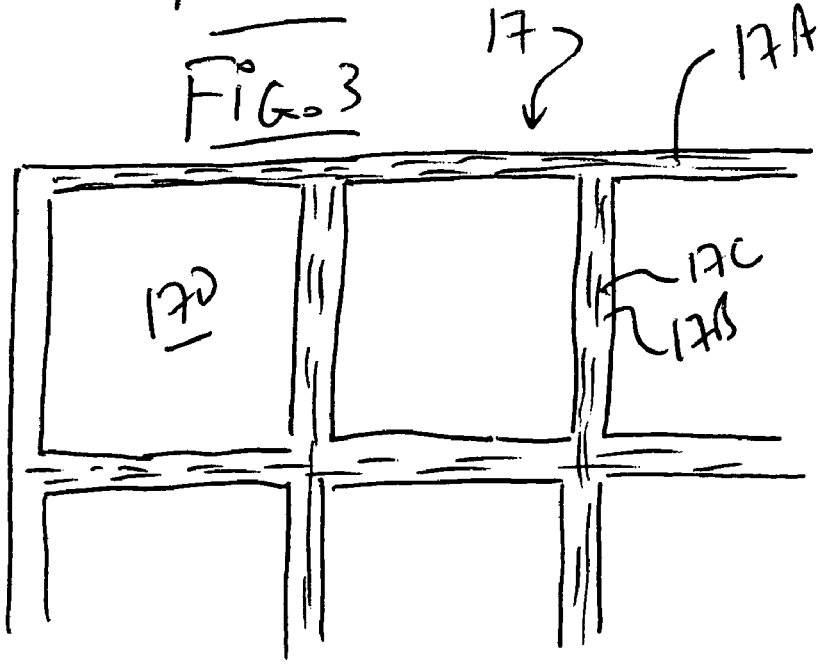

CATHODIC PROTECTION OF STEEL WITHIN A COVERING MATERIAL

This invention relates to a method for cathodic protection of steel materials in a covering material such as mortar or concrete, which is particularly but not exclusively arranged for use with steel reinforced concrete structure.

BACKGROUND OF THE INVENTION

Cathodic protection of steel elements at least partly embedded in a surrounding layer is well known and methods for this purpose are described in PCT Application CA00/00101 filed 2 Feb. 2000 and published as WO 00/46422 and in PCT Application CA02/00156 filed 24 Jul. 2002 and published as WO 03/010358 both by the present inventor.

In the first above application is disclosed an addition into the anode body of an enhancement material in the form of a humectant which enhances the ion flow and maintains the anode electrochemically active during its life. The enhancement material may be contained within the sacrificial anode material of the anode body rather than in a surrounding mortar or the like. In the second application is disclosed an arrangement in which the sacrificial anode material is inhibited from cracking by forming the anode material with pores which are generally sufficient to contain the expanding corrosion products. This can be achieved by compressing fine materials such as powder or flakes or by compressing or crumpling solid sheet material so that pores or interstices are formed between the crumpled layers.

In PCT Published Application WO 94/29496 of Aston Material Services Limited is provided a method for cathodically protecting reinforcing members in concrete using a sacrificial anode such as zinc or zinc alloy. In this published application and in the commercially available product arising from the application, there is provided a puck-shaped anode body which has a coupling wire attached thereto. In the commercially available product there are in fact two such wires arranged diametrically opposed on the puck and extending outwardly therefrom as a flexible connection wire for attachment to an exposed steel reinforcement member.

The puck is surrounded by an encapsulating material such as mortar which holds an electrolyte that will sustain the activity of the anode. The mortar is compatible with the concrete so that electrolytic action can occur through the mortar into and through the concrete between the anode and the steel reinforcing member.

The main feature of the published application relates to the incorporation into the mortar of a component which will maintain the pH of the electrolyte in the area surrounding the anode at a high level of the order of 12 to 14.

In use of the device, a series of the anodes is provided with the anodes connected at spaced locations to the reinforcing members. The attachment by the coupling wire is a simple wrapping of the wire around the reinforcing bar. The anodes are placed in locations adjacent to the reinforcing bars and re-covered with concrete to the required amount.

Generally this protection system is used for concrete structures which have been in place for some years sufficient for corrosion to start. In general, areas of damage where restoration is required are excavated to expose the reinforcing bars whereupon the protection devices in the form of the mortar-covered pucks are inserted into the concrete as described above and the concrete refilled.

These devices are beginning to achieve some commercial success and are presently being used in restoration processes. However improvements in operation and ergonomics are required to improve success of this product in the field.

U.S. Pat. No. 6,193,857 (Davison) assigned to Foseco discloses an anode body in the form of a puck coated with a mortar in which the puck is attached by ductile wires to the rebar within an excavation in the concrete.

In U.S. Pat. No. 5,714,045 (Lasa et al) issued Feb. 3, 1998 to Alltrista Corporation is disclosed a jacketed anode assembly for use in a sacrificial anode cathodic protection system deployed to impede corrosion of steel or steel reinforcement in pilings or similar supporting columns. A non-conductive jacket formed of mating shell halves is lined along its interior surface with sheets of expanded metal such as expanded zinc. The metal sheets are of a composition higher on the galvanic series than the steel reinforcement such that the sheets serve as sacrificial anodes when coupled with the steel reinforcement. The jacket and zinc lining are installed as a unit on the piling with the jacket interior surface facing the periphery of the piling and in spaced apart relationship therewith. In this space, a filling material can be introduced to both secure the metal sheets in place between the jacket and piling as well as serve as an electrolyte between the steel reinforcement and the metal sheet. This commercial success of this method has been limited by the high cost of the jacket which can match the cost of the active components of the anode and coating and has little technical advantage, thus providing a significant cost disadvantage.

In this arrangement the anode is located immediately at the jacket so that one purpose of the jacket is to locate and hold the anode directly at the surface of the additional cast layer. The jacket is therefore essential to this process in that it must be present in order to locate the anode. The jacket does not have sufficient structural strength to act, without additional strengthening members, as a form for the concrete and does not apply forces on the anode inside it but only acts to maintain a layer of water within the jacket which may assist in maintaining the anode active.

The anode is located directly at the surface so that it is located wholly at the surface and is not buried within the layer in a manner in which expansion of the anode member would cause breakdown or cracking of the concrete or separation of the anode from the concrete. This avoids problems of containment of the corrosion products since the corrosion products can readily diffuse away from the outside surface in the wet environment within which the columns are located, particularly as the corrosion products are formed at or adjacent the surface of the layer and the jacket retains a layer of water which can wash away the corrosion products.

Corrosion products generally occupy more volume than the anode material from which they are formed. In some cases the corrosion products are soluble or at least partially soluble so that, for example in a marine environment which is very wet or fully submerged, diffusion will occur rapidly with little or no pressure developing by the expansion of the corrosion products.

However most applications of cathodic protection systems of this type are in dry, that is non-submerged, environments and in these conditions the corrosion products are generally in solid form. Diffusion of the corrosion products in solid phase is very slow. Thus, even though the corrosion products may, over extended time periods, diffuse away from the anode body thus reducing forces from expansion, this diffusion in most cases is very slow and even where there are adjacent pores or openings in the covering material or in the anode structure itself, the corrosion products may generate significant expansion forces if the anode corrodes quickly, due to the slower diffusion movement of the corrosion products.

In most cases the galvanic anode is intended to be designed to corrode as, quickly as possible so as to maximise the protection effect. When so designed for rapid corrosion, the corrosion rate and the rate of corrosion product generation can exceed the ability of the system to absorb or carry away the corrosion products. This will therefore generate pressure due to the expansion.

It is possible to design the system so as to limit the rate of corrosion to address this problem so that the rate of diffusion or take-up of the corrosion products acts as the limiting factor to the rate of corrosion which can be accommodated. As set forth in the above published PCT application of the present inventor, increasing the porosity of the anode can increase the rate at which corrosion products can be absorbed. The same effect can be obtained by increasing the porosity of the concrete surrounding the anode body. However this can be detrimental as it decreases structural strength and provides voids which can contain water with the: potential for freeze/thaw damage.

SUMMARY OF THE INVENTION

It is one object of the present invention, therefore, to provide an improved method of cathodic protection of steel within a covering material, where the steel is protected by providing an anode material in the covering material which provides an ionic current to the steel through the covering material, which method can accommodate an increased level of corrosion of the anode while restricting damage to the covering material from the expansion of the anode body from the production of corrosion products.

According to a first aspect of the invention, therefore, there is provided a method for cathodic protection comprising:

providing steel material;

applying a covering material such that a part of the steel material is at least partly covered by the covering material;

forming a cathodic protection combination by:

providing an anode member;

arranging the anode member at least partly in contact with the covering material for communication of ions therebetween;

and electrically connecting the at least one anode member so that an electrical potential between the anode member and the steel material causes ions to flow through the covering material tending to inhibit corrosion of the steel material while causing corrosion of the anode member;

wherein the corrosion of the anode member acts to form corrosion products where the corrosion products have a greater volume than that part of the anode member from which the corrosion products were formed thus tending to cause expansion of the anode member, the contact between the anode member and the covering material being such that the expansion tends to breakdown the covering material or the connection between the covering material and the anode member;

and causing restraining forces on the anode member tending to restrict the expansion and the breakdown caused thereby by providing a reinforcing layer at or adjacent the anode member which applies said restraining forces to the anode member.

The invention is applicable both to repairs where some of the existing covering material is excavated to expose the existing steel and the fresh covering material is applied over the exposed steel, to overlays or new structures where the steel within the fresh covering material is wholly new steel and to arrangements which include both a repair or patch and an overlay.

The method described above is particularly applicable where the anode member is wholly buried in the covering material or is inserted into a hole in the covering material so that it is contained therein on at least three sides. Such containment of the anode body on three or four sides will cause expansion of the anode member to effect cracking of the covering material or effect expulsion of the anode body from its position within the covering material. However the same method can also be used with advantage where the anode body is not so contained since in many cases, the expansion will cause a breakdown of the electrico-chemical connection between the anode body and the covering material thus interfering with the operation of the cathodic protection system.

The term "steel material" as used above is intended to refer generally to any steel component or components which are in contact with the covering material in a manner such that corrosion can occur. The term is used to maintain generality as to the number and type of components within the fresh material and/or the existing material. Such components may be wholly or only partly buried within the covering material. The term may relate to steel reinforcing elements or bars within the covering material, to steel elements within the covering material which are structural and to steel elements within the covering material which are non-structural and non-reinforcing but which can corrode. In many cases the steel material is in the form of a plurality of steel elements, generally reinforcing bars. However the term is intended also to cover a single element such as a beam.

While the present invention is primarily concerned with concrete as the covering material, it will be appreciated that it is not so limited and other materials such as mortar, masonry or stone which allow the communication of ions to the reinforcing steel can also require to be protected in this manner. Mortar can be used in stone or brick constructions as a filler material and the present invention can also be used in such circumstances.

The existing covering material and the fresh covering material are in most cases the same material and in most cases concrete, but it will be appreciated that the fresh material need not be the same as the original material provided both cooperate with the steel in a galvanic action with the anode members and provided there is communication of ions through the interface between the existing and the fresh materials.

In many cases, the anode member or members are wholly buried or embedded within the covering material. However the anode members may be partially embedded or even located on the surface of the fresh concrete provided they are in ionic communication with the steel in the structure.

This method may be advantageous where the anode body itself is porous and thus provides pores for receiving the expanded corrosion products. Such a porous anode material may be formed at least partly of finely divided materials such as powder or flakes or other materials such as wire or foil which are pressed together. Such anode body may also include admixed therewith an enhancement material for co-operating with the sacrificial anode material in enhancing the communication of ions between the covering layer and the anode material, which material is bound into the sacrificial anode material of the solid anode body so as to be carried thereby.

In one embodiment, the reinforcing layer may be located at or just within an exterior surface of the anode member.

In another embodiment, the reinforcing layer may be located at or within an exterior surface of a coating material, separate from the covering material, surrounding the anode member.

In yet a further embodiment, the reinforcing layer may be located at or within an exterior surface of the covering material.

When located in the anode body, the reinforcing layer preferably forms a substantially closed surface which substantially surrounds the anode member so as to mainly contain the forces within the closed surface.

When located in the covering material, the reinforcing layer preferably has openings therein sufficient to allow the covering material, when in an un-set condition, to pass through the openings.

When located in the covering material, the anode member is located within an external surface of the covering material and the reinforcing, layer is located generally between the external surface of the covering material and the anode member.

Preferably the reinforcing layer is a mat having openings therethrough, filled with the material within which the layer is embedded, to allow communication of ions within the material through the openings.

Preferably the reinforcing layer has fibrous reinforcement, although strength for the reinforcement layer may be provided by other reinforcing elements including metal.

The reinforcing layer may also be arranged in the covering layer so that it also provides additional reinforcement to the covering material itself, thus for example replacing, in a repair, steel which has been corroded and lost.

In one preferred arrangement, the anode member comprises an electrically conductive array which is at least partly formed by said anode material and which is arranged to follow substantially the shape of an exterior surface of the covering material. Such an arrangement may be used where the covering material is applied as a cladding of an additional layer onto an existing structure. The anode member in the array may be buried within the additional layer and the reinforcing layer may be buried within the additional layer over the array or the reinforcing layer may be on the surface of the covering material. While this can be done as a deck or flat structure, the existing structure may be a column with the anode member forming a cylindrical array surrounding the existing column and the reinforcing layer in a cylindrical layer over the array.

In a particularly preferred arrangement, the anode member and the reinforcing layer may be supplied as an assembly and the anode member may be located within the additional layer of covering material and maintained spaced from the exterior surface and from the existing column, during setting of the additional layer, by spacer members carried by the assembly. The reinforcing layer may be buried or may be on the surface.

Where the structure concerned is a column, an additional layer of covering material is contained during setting in a flexible cylindrical form.

According to a second aspect of the invention there is provided an anode member for cathodic protection of steel material in a covering material where at least a part of the steel material is at least partly covered by the covering material, the anode member comprising:

an anode body at least partly formed from a sacrificial anode material arranged such that an electrical potential between the anode member and the steel material causes ions to flow through the covering material tending to inhibit corrosion of the steel material while causing corrosion of the anode member;

the anode body being arranged for electrical connection to the steel material;

wherein the corrosion of the anode member acts to form corrosion products where the corrosion products have a greater volume than that part of the anode member from which the corrosion products were formed thus tending to cause expansion of the anode member;

and a reinforcing layer at or within an external surface of the anode member so as to cause restraining forces on the anode member tending to restrict the expansion.

According to a third aspect of the invention there is provided a combination comprising;

an anode member for cathodic protection of steel, material in a covering material where at least a part of the steel material is at least partly covered by the covering material, the anode member comprising:

an anode array at least partly formed from a sacrificial anode material arranged such that an electrical potential between the anode member and the steel material causes ions to flow through the covering material tending to inhibit corrosion of the steel material while causing corrosion of the anode member;

the anode array being arranged for electrical connection to the steel material;

wherein the corrosion of the anode array acts to form corrosion products where the corrosion products have a greater volume than that part of the anode member from which the corrosion products were formed thus tending to cause expansion of the anode member;

the anode array being arranged to follow substantially the shape of an exterior surface of the covering material;

and a reinforcing layer for location within the covering material adjacent the anode array so as to cause restraining forces on the anode array tending to restrict the expansion.

BRIEF DESCRIPTION OF THE DRAWINGS

Embodiments of the invention will now be described in conjunction with the accompanying drawings, in which:

FIG. 2 is a top plan view of the array of FIG. 1.

FIG. 3 is a front elevational view of the reinforcing layer of FIG. 1.

DETAILED DESCRIPTION

Figure 1:
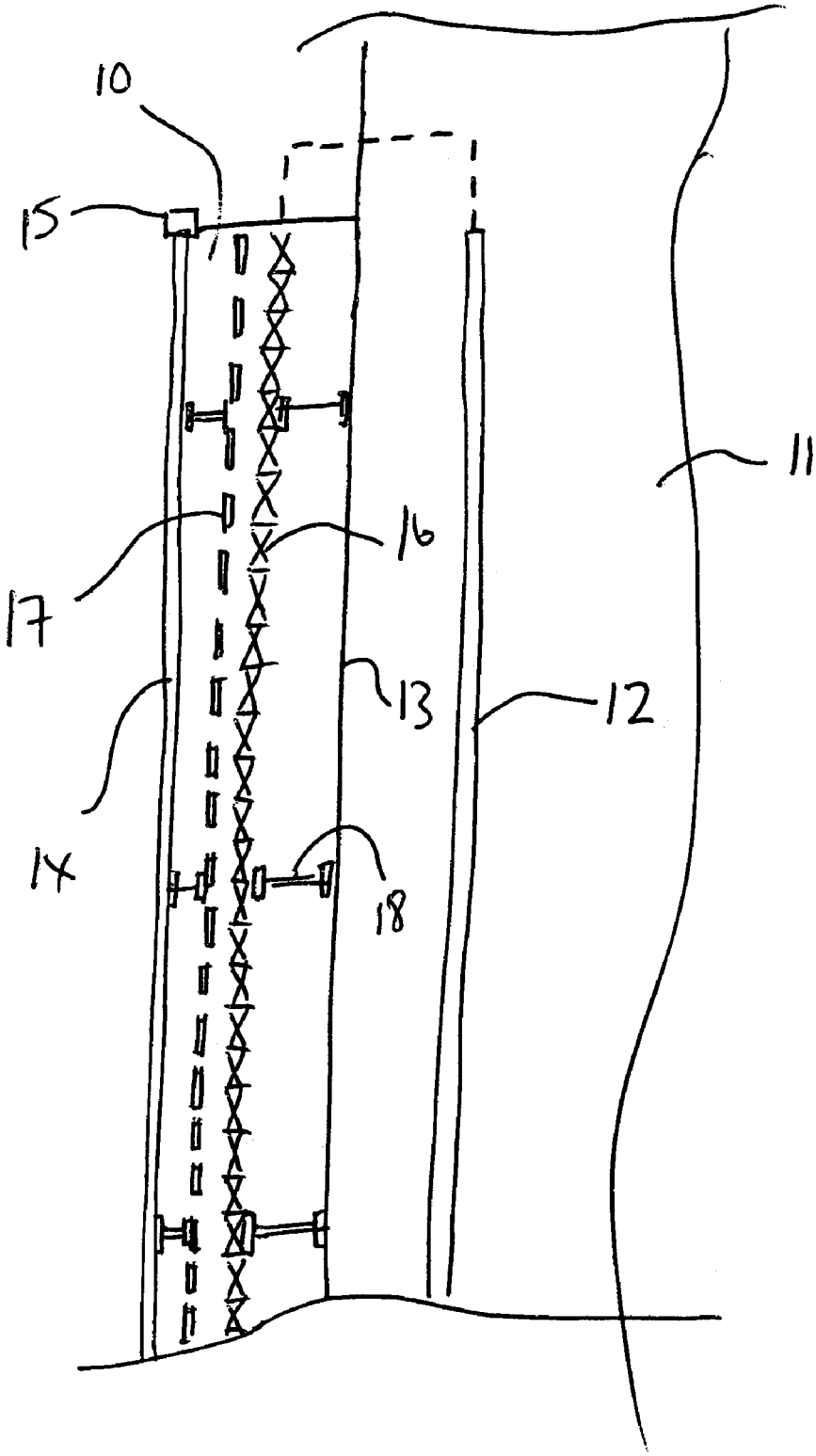
FIG. 1 is a cross sectional view of one embodiment according to the present invention including an anode array installed within a covering layer of fresh concrete applied to an existing column.

Attention is directed to the disclosure in the above PCT Applications by the present inventor which discloses the manufacture and use of anode bodies including anode materials, enhancement materials and methods of installation. The present embodiments disclosed herein include and use many of the constructions, arrangements and enhancement materials described therein.

The enhancement materials and the sacrificial anode material, such as zinc, can be pressed together to form a porous body as shown and described in the above applications, to which reference may be made for further details.

Preferably the anode body is formed simply by pressure on the particulate materials and typically pressures to effect sufficient compaction to maintain an integral structure will be in the range 5,000 psi-to 40,000 psi. Heat is therefore preferably not used but can be used to effect a melting of the particles at the points of engagement to enhance structural integrity. However heat can damage many enhancement materials and hence is difficult to use and may require a vacuum to prevent combustion.

The zinc particles can be supplied in the form of powder having a size in the range 325 mesh (that is particles which will pass through a 325 mesh) to 0.25 mm. The particulate materials can be wholly powder but preferably contain a proportion of shavings, fibers or flakes which have increased dimension in one or two directions. Thus fibers may have dimensions of the order of 1 mm to 6 mm in the length direction and a transverse dimension of the order of 0.1 mm. Flakes may have dimensions of the order of 1 mm to 6 mm in the longer directions and a thickness of the order of 0.1 mm. Such shavings, fibers or flakes are commercially available from a number of suppliers. It will be appreciated that the use of particles having increased dimensions in one or two directions increases the mechanical interconnection between the particles thus providing an increased structural strength and an increased structural integrity. The anode body can be formed wholly of such shavings, fibers or flakes. However the cost of this structure of zinc particles is significantly higher than simple powder and hence it is highly desirable to provide an economic balance based upon selecting lower cost powder materials with a suitable proportion of higher cost shavings to provide the required structural integrity and pore dimensions. Typically shavings might form a 20% proportion of the total volume of the zinc particles.

As an alternative to the particulate materials, foil or sheet material can be crumpled and compressed using a similar mold and pressures so as to define pores between the, overlying layers of the crumpled sheets. The foil has the advantage of providing continuous connection between the metal parts of the anode while also providing the pores which allow absorption of the corrosion products.

The enhancement material is preferably particulate having a particle size in the range 0.1 mm to 1 mm and is preferably in crystalline form. However other forms of the enhancement material might be used including powder or a pellet form having a significantly greater dimension up to 8 mm. The use of the larger pellets provides improved physical properties in that there is greater particle-to-particle contact between the zinc particles than can be obtained using smaller particles in powder form. This is achieved because there are reduced number of pellets which are thus located in specific smaller number of locations within the zinc particles thus allowing improved contact between the zinc particles themselves. However it is also a requirement that the enhancement material be spread throughout the zinc so that there also a requirement or a desirability to ensure that the areas of enhancement material are not so isolated from all of the zinc so that the enhancement can not properly occur. Thus a balance must be selected between particle size to ensure that the enhancement operates effectively during the life of the zinc anode while obtaining a suitable structural integrity. Either the powder or pellets of the above dimensions have been found to operate satisfactorily.

The ratio of the zinc particles to the enhancement particles is preferably of the order of 60% zinc particles by volume. However the zinc content may range from 30% to 95% by volume.

Using the above typical pressures, using metal particles of the above dimensions and using the enhancement materials as defined above, the total volume of void within the finished anode body is typically of the order of 5% to 40%. The anode body can be formed without any enhancement materials so that it is formed wholly (100%) of the zinc particles defining the pores within the metal body. In such an arrangement it is preferable to have a higher level of void so as to provide sufficient void, volume to absorb the corrosion products during the life of the corrosion of the zinc anode body.

In an arrangement where enhancement material is used, it will be appreciated that the compression of the zinc particles forms a series of pores within the zinc structure, some of which are empty so as to form voids, some of which are wholly filled by the enhancement material, and some of which are partly filed with the enhancement material. When the enhancement material is used, some of the voids which are partly or wholly filled with the enhancement material can become available to absorb the corrosion products. Thus in such a case there is the possibility to reduce the total void volume. Thus in other words some of the enhancement material is utilized in the corrosion process and thus makes available its space previously occupied for the receipt of corrosion, products. Yet further, some of the enhancement materials may be soluble so that they may gradually defuse out of the anode body leaving their original space available for the corrosion products.

Yet further some enhancement materials, such as lithium hydroxide or calcium chloride, have the advantage that they render the corrosion products more soluble so that the corrosion products themselves may diffuse in solution out of the anode body into the surrounding concrete. Thus it is advantageous to provide the pores of the present invention so that absorption of corrosion products can occur but the total volume of pores required may be reduced relative to the total volume of corrosion products in view of this diffusion of the corrosion products during the life of the process.

During the life of the process, typical expansion of the volume of the anode body in view of the corrosion products can be achieved in the range 20 to 30 percent, but can be much higher in some cases and particularly when using magnesium or other materials. Thus it is theoretically necessary to absorb into the anode body itself this expansion. However in view of the above factors it is not necessary in all cases to provide a volume of void space within the anode body equal to the anticipated expansion. The use of the enhancement material within the anode body itself provides the advantages of making available the above additional void space and the possible advantage of rendering more soluble the corrosion products. However it is not essential to provide the enhancement material within the anode body itself since it is possible to provide the enhancement material in a mortar or filler surrounding the anode body. In yet other cases the enhancement material may be omitted since advantage can be obtained simply by using the porous anode body set forth above without any enhancement material.

The humectant material or other enhancement material, if used, is thus selected so that it remains supported by and admixed into the anode or material surrounding the anode so that it does not significantly migrate out of the anode body during storage or in use.

This arrangement has the advantage that the finished product is porous and that corrosion products from corrosion of the anode body during operation can be received into the pores of the porous body and thus avoid sufficient expansion of the anode body to cause cracking of the concrete. This allows the surface of the anode body to lie in direct contact with the concrete either by embedding directly within the concrete, as shown in FIG. 2 or by insertion as a tight fit within a hole. In such cases the amount of pore volume available allows the pressure from the expanded corrosion products to be absorbed within the anode body itself without the necessity for additional materials which act to absorb this pressure or without the modification of the concrete so as to accommodate the pressure.

This is particularly effective when combined with the arrangement shown herein where the body is embedded wholly within the concrete so as to be in direct contact with the concrete so as to communicate expansion forces, if any to the concrete. This formation of the anode body to define pores can be used without the addition into the anode body of the enhancement material. Thus the discrete anode body in porous form, if formed without the enhancement material will be formed wholly of the metallic anode material. The formation and the degree of compression can be selected to generate a porous structure with sufficient pore size and number per unit volume that the whole of the corrosion products is taken up into the pores thus avoiding any expansion of the body caused by the generation of the corrosion products. In addition this may allow the use of other materials such as aluminum or magnesium which are generally considered unsuitable because the corrosion products have a high increase in volume relative to the original metal thus causing severe cracking problems.

The electrical connection from the anode material to the steel rebar is preferably provided by a material separate from the anode material itself such that its electrical connection is not lost or compromised during the corrosion of the anode. The connecting material is preferably steel.

Also the present invention is primarily concerned with concrete structures but some aspects, such as the anode construction, can also be used with other situations where a steel element is buried within a covering layer. The above description is directed to the primary use, but not sole use, with concrete structures.

The cathodic protection device therefore operates to form an electrolytic potential difference between the anode and the steel reinforcing member which causes a current to flow therebetween through the electrical connection and causes ions to flow therebetween through the concrete sufficient to prevent or at least reduce corrosion of the steel reinforcing bar while causing corrosion of the anode.

The level of the pH and the presence of the humectant enhances the maintenance of the current so that the current can be maintained for an extended period of time for example in a range 5 to 20 years.

The presence of the humectant material bound into the anode body acts to absorb sufficient moisture to maintain ion transfer around the anode to ensure that sufficient output current is maintained during the life of the anode and to keep the anode/filler interface electrochemically active. The presence also increases the amount of the current.

The anode can be formed of any suitable material which is electro-negative relative to the steel reinforcing members. Zinc is the preferred choice, but other materials such as magnesium, aluminum or alloys thereof can also be used.

This arrangement of providing the agent directly in the anode body allows the construction of an anode body which is of minimum dimensions thus allowing its installation in smaller locations or holes and thus allowing installation in locations where space is limited and thus reducing costs for forming the excavation to allow the installation.

In FIG. 1 is shown a first embodiment of the present invention which utilises a reinforcement layer to provide restraining forces tending to restrain the expansion of the anode body in view of the formation of the corrosion products within or around the anode body. In the embodiment shown in FIG. 1, the arrangement is used to provide an addition surrounding jacket 10 on an existing concrete column 11 reinforced by existing steel members 12.

The additional layer of concrete formed in the jacket 10 is applied onto the outside surface 13 of the existing column. Repairs to the outside surface may firstly be carried out which in some cases may involve removal of some of the concrete structure and in some cases exposing the steel 12. However this may not be necessary in some circumstances.

The concrete is applied to the outside surface of the, column 11 using a form 14 in the form of a simple cylindrical fabric or flexible container which has a diameter greater than that of the outside surface 13 by a distance sufficient to form the required thickness of the jacket 10. The simple fabric container can be supported by a hoop 15 at the upper end of the intended jacket and can be closed at the bottom end to clamp around the column. The flexible container thus formed naturally takes up a cylindrical shape co-axially surrounding the cylindrical surface 13 so as to provide a constant thickness of the jacket 10. Thus the simple flexible fabric form 14 can be very inexpensive and thus can be simply left in place if preferred or can be removed if desired.

Within the form 14 so as to be buried, in this embodiment, within the concrete jacket 10 is provided an anode 16 and a reinforcing layer 17. The anode 16 forms a cylindrical body or array surrounding the surface 13 at a constant spacing therefrom. The array forming the anode can be supplied as a flat sheet which is curved around the column with the butting edges of the flat sheet after wrapping around the column being connected to complete the cylindrical surface completely surrounding the column.

In another embodiment, not shown, the reinforcement layer 17 may be provided at the outer surface of the concrete and may provide the form for supporting the concrete during poring.

As part of the same structure is provided the layer 17 which is attached to the outside surface of the anode 16 so that the two sheets forming the anode and the layer can be supplied as a common structure together with a plurality of spacer members 18 which are attached to the inside and outside surfaces respectively of the combination defined by the anode 16 and the reinforcing layer 17. The spacers 18 comprise simple legs of the required length to support the combination at the required position within the jacket 10. The spacers 18 are arranged at suitable angular locations around the column as shown in FIG. 2.

The anode array 16 is formed from expanded zinc sheet. The expanded metal is of course a well known stamping arrangement which provides openings through the sheet thus increasing the surface area and allowing the passage through the sheet of the aggregate within the layer of the jacket 10. In one example, the typical zinc anode would have a thickness in the range 0.025 inch to 0.150 inch and typically 0.072 to 0.100 and be stamped to provide expanded openings of the order of 10 to 40 mm in transverse dimension which allows the passage of the aggregate. The array however may be formed from other constructions including a mesh or a woven fabric or strips (ribbons) or castings. The metal of the anode is typically zinc but other suitable metals are available as well known to one skilled in the art.

The layer 17 can lie directly in contact with the anode or can be spaced away from the anode by a distance which is sufficiently small that it still provides its required function of restraining the expansion forces. In the arrangement as shown where the layer 17 is supplied as a common structure with the anode, the layer is attached to the anode by suitable connectors at spaced locations across the array to hold the two elements attached. The attachments and the legs may be commonly constructed.

The layer 17 as best shown in FIG. 3 is formed from a web or mat of fibre reinforced plastics material to define a mesh of right angle strips 17A and 17B moulded together by the thermoset plastics materials containing the fiber reinforcements 17C. The fibres may be glass or carbon or other similar materials which provide the required strength in accordance with the engineering requirements of the structure as will be determined by one skilled in the art. The mesh of strips 17A and 17B provides openings 17D having a transverse dimension of the order of 5 to 75 mm which is sufficiently large to allow the penetration of the aggregate. The openings 17D also allows the concrete to set through the openings thus locating the mesh within the concrete but allowing the communication of ions in the concrete through the opening 17D, if necessary, from the anode array to the steel. In the example shown the layer is located wholly outwardly of the anode array so that ion communication through the layer is, not important in this case. However, it will be appreciated that in some circumstances there may be some part of the layer in between the steel and the anode thus requiring the passage of the ions through the layer to provide the required cathodic protection.

If the layer 17 is located at the surface of the concrete as a form, it would form a substantially closed layer of fabric or other suitable material holding the concrete inside but possible allowing the escape of some liquid.

The structure of the layer may vary so that the size of the openings may be significantly smaller in some circumstances if the aggregate is not required to pass through. However, if located between the anode and the steel, the layer cannot be a continuous insulator or dielectric layer since that would interfere with the passage of the ions and would generate a plane for de-lamination of the concrete.

The materials from which the layer are formed can vary and can include plastics materials commonly in a woven or non-woven mesh. Uncoated steel generally would not be used since this would attract some of the ions and interfere with the cathodic protection or require additional anode material to be provided. However steel may be used as a reinforcing material if painted, galvanized or otherwise treated to prevent the steel from attracting a significant portion of the ions or if the required additional anode material is provided.

The operation of the layer is that it applies forces onto the anode array or the anode body tending to resist the forces outward of the anode body caused by the expansion from the formation of corrosion products. This therefore applies a pressure onto the anode body assisting in causing the dispersion of the corrosion products into available pores. In addition the layer resists the tendency of the concrete or other covering material to break apart or fall off as it is pushed away from the anode body by the expansion of the corrosion products. Thus additional forces compressing the anode body are provided by the layer and in addition any expansion caused by the anode body is resisted within the concrete thus inhibiting or preventing the damage of the concrete due to the movement. At the same time any cracking which does occur does not cause the concrete to fracture and separate into pieces since it is held together by the layer.

Yet further, the layer 17 can be engineered by one skilled in the art to provide additional structural strength to the concrete to supplement or replace structural strength otherwise provided by the steel within the concrete. Thus the layer 17 can carry out the functions of both restraining the expansion forces and in addition providing additional structural strength to the concrete in the layer thus removing or reducing the necessity for additional reinforcing steel.

The thickness and structural strength of the layer will vary widely depending upon the engineering parameters of the structure and these can be selected and arranged in accordance with the knowledge and calculations of one skilled in the art.

Figure 4:
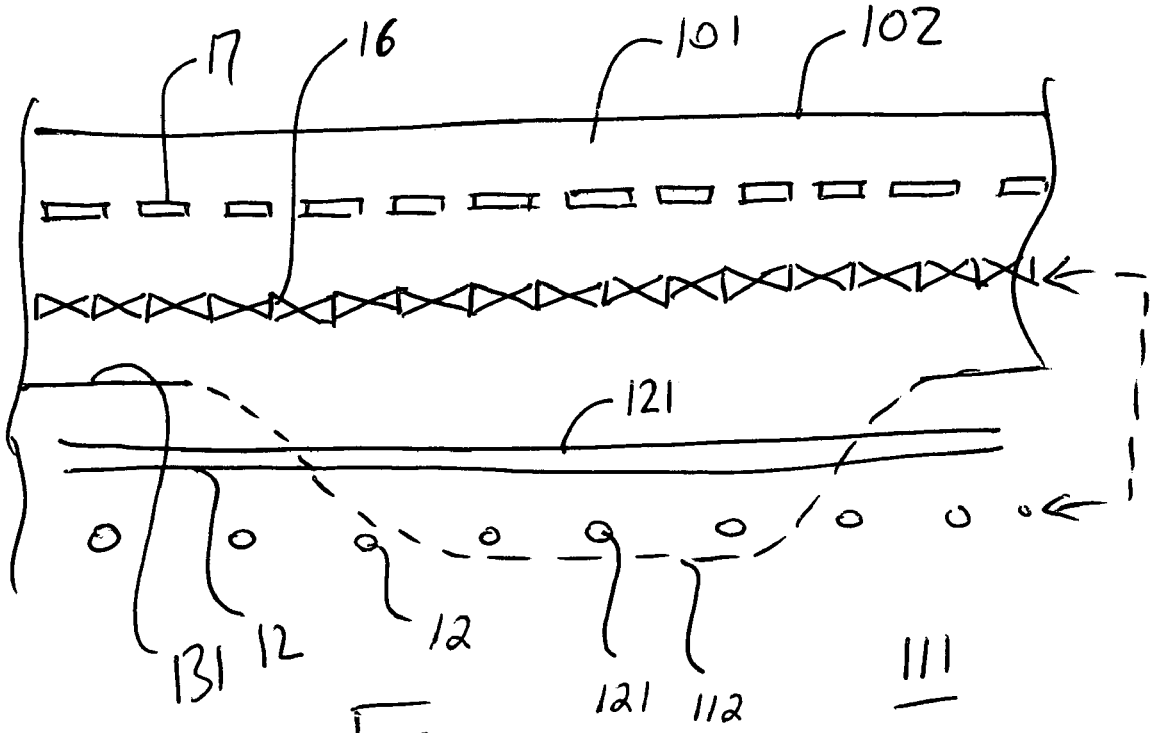
FIG. 4 is a cross sectional view of another embodiment according to the present invention including an array for use in a patched area of a deck.

In FIG. 4 is shown a similar arrangement throughout our FIGS. 1, 2 and 3 but the additional layer 101 is used in this embodiment with a structure that has a flat outside surface 131 such as a vertical wall or horizontal deck. In this embodiment a portion 112 of the existing structure 111 has been removed during the repair to expose portions 121 of the steel 12.

In this embodiment the anode, array 16 is, flat so that it is laid out generally parallel to the outside surface 102 of the layer 101. In this embodiment the layer 17 is separate from the anode so that the anode 16 is laid down firstly at a position spaced from the surface 131 and then the layer 17 is installed upwardly from that so that each is laid down independently from an independent supply. Alternatively the layers 131 and 17 can be pre-attached in advance and installed as a unit. Suitable spacers can be provided but are not shown as these will be well known to one skilled in the art. Again the spacings through the anode array and through the layer 17 are sufficient to allow the aggregate within the concrete layer to pass through so the concrete fills into the area of the surface 131 and the area of the repair 112.

Figure 5:
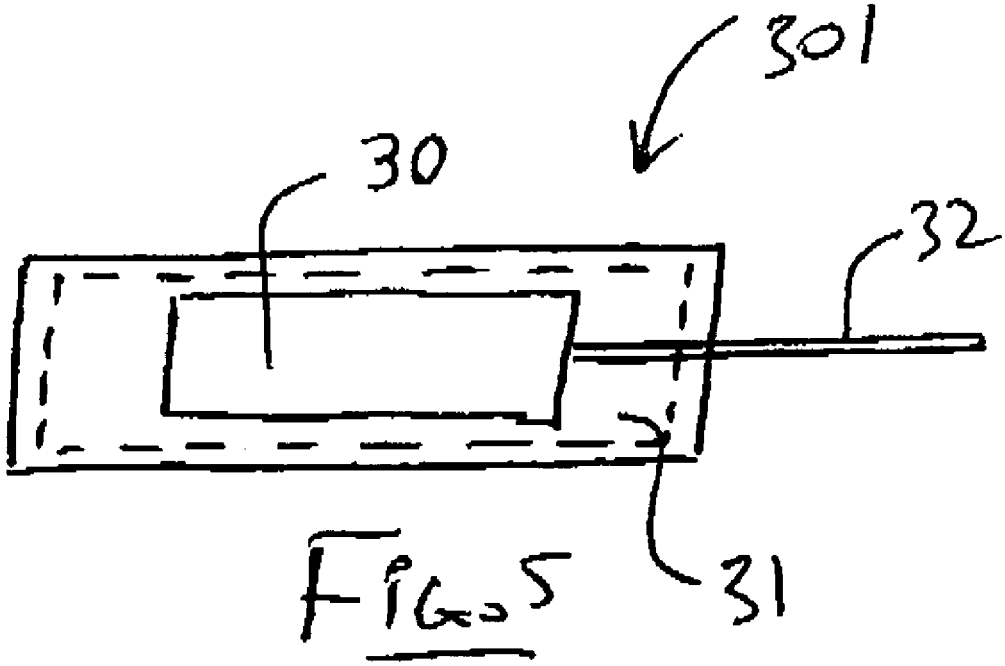
FIG. 5 is a longitudinal cross sectional view of a second embodiment anode member including a mortar coating with the reinforcing layer contained within the mortar layer.
Figure 6:
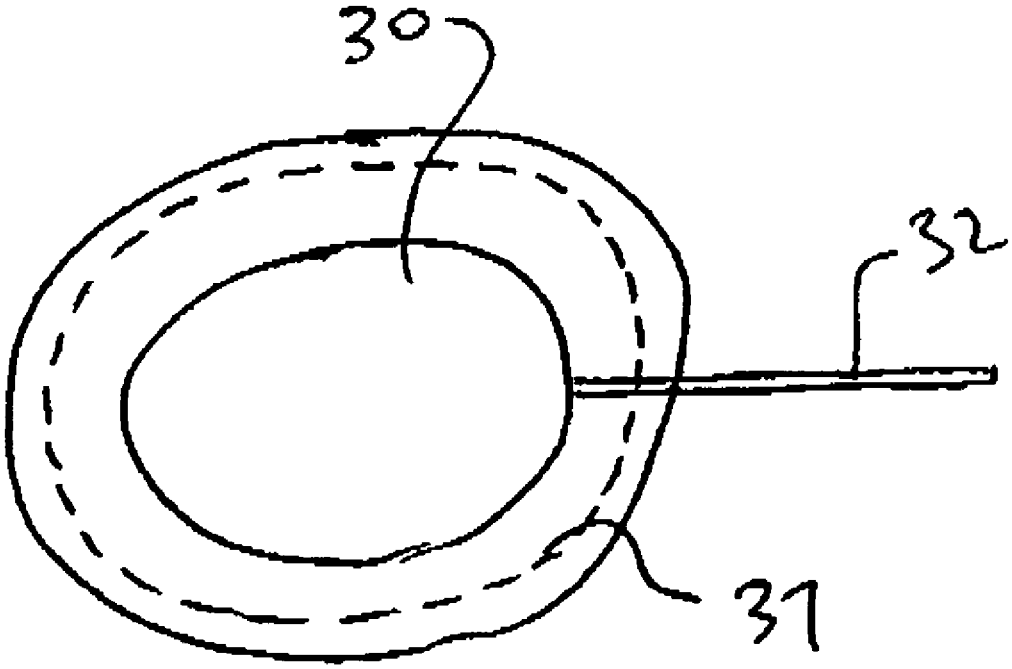
FIG. 6 is a transverse cross-sectional view of the embodiment of FIG. 5.

In FIGS. 5 and 6 is shown an alternative arrangement which uses a puck or anode body generally indicated at 301 which has a core 30 of the anode material surrounded by an outer layer 31 of a mortar or other suitable filler material. Such pucks are well known and described in the above PCT application published by the present inventor and by Aston as identified above. A wire 32 is connected to the anode body 301. In this embodiment a layer 37 is located within the mortar and fully surrounds the core of the anode body formed from the sacrificial anode material thus forming an essentially closed surface surrounding the anode material. In practice the layer may not fully surround the anode body, so that it is not closed, but it surrounds the anode body sufficiently to contain the forces. Thus the layer may be open at one end and/or may be open sufficiently to allow the passage of the necessary connection wires. For example an elongate cylinder with open ends may provide sufficient restraint to contain the forces. The layer 37 is formed from a mesh or fabric again of fibrous nature which provides sufficient strength to resist the outward forces caused by the expansion of the corrosion products. The layer 37 is formed in the mortar as a tight structure so that it resists expansion and applies forces inwardly. The layer 37 includes openings between the fibres or yarns of the structure which allow ions to pass from the sacrificial anode material through the mortar to the covering material applied over the mortar when the puck is in place within the structure. Further details of suitable constructions for the anode body including the core and the mortar can be found in the above publications, to which reference may be made for additional details. The layer 37 can be located immediately adjacent the outside surface of the sacrificial anode body 301 or can be located further outwardly even as far as the outside surface of the mortar material 31. In one possible manufacturing process, the layer 37 may form the inside surface of a mould for casting the mortar material around the pre-formed body 301.

Figure 7:
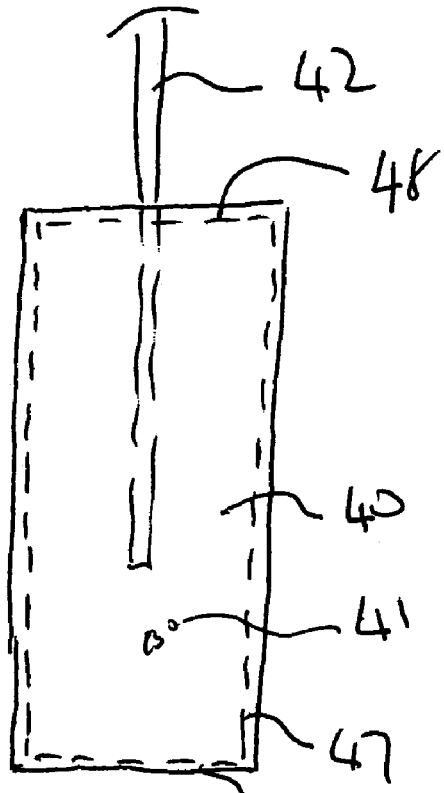
FIG. 7 is a cross sectional view of a third embodiment of an anode member including a reinforcing layer contained at the outer surface of the anode material.
Figure 8:
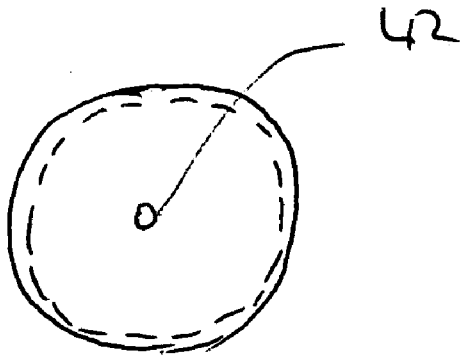
FIG. 8 is a transverse cross-sectional view of the embodiment of FIG. 7.
Figure 9:
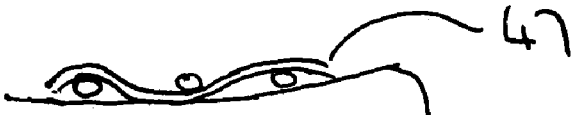
FIGS. 9 and 10 are schematic views of the reinforcing layer of FIG. 7 on an enlarged scale showing the spaces through which ion communication takes place.
Figure 10:
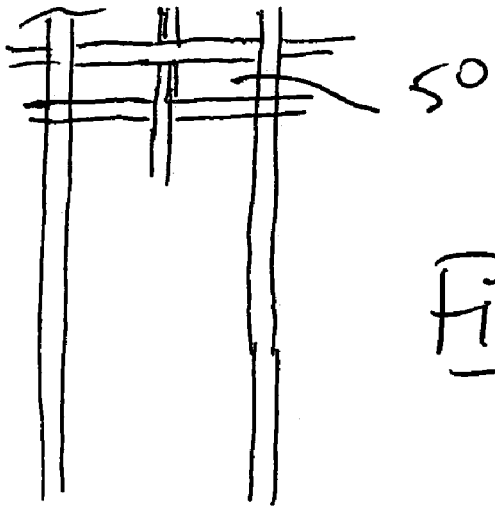

In FIGS. 7 and 8 is shown an alternative arrangement using the construction described particularly in the PCT application CA 02/00156 of the present inventor where the anode body is formed substantially wholly by the anode material itself which is pressed to form an anode body 40 having pores 41. In the embodiment shown the anode body is cylindrical following the shape disclosing the above application and includes a connector lead 42. The layer 47 which confines the forces within the anode body is located in this embodiment at the surface so as to contain the whole of the anode material and apply forces onto the anode material to prevent the expansion. Thus the layer 47 forms a cylindrical shape with end faces 48 and 49 of domed shape and a cylindrical wall which forms a closed surface. The layer can thus be laid on the inside surface of the mould forming the pressed structure of the anode body as previously described in the above application. As shown in FIGS. 9 and 10, there is illustrated the layer 47 at the outside cylindrical surface of the body 40 which forms a woven structure providing fibres in both the, longitudinal and circumferencial directions for confining the expansion forces. Between the fibers is located spaces 50 which allow connection of the anode material to the surrounding covering material to provide ion communication between the anode and the steel of the covering material. The pressure from the layer 47 prevents or reduces the expansion of the anode body thus allowing selection of the parameters for the anode body which provide optimum or maximum corrosion rate. The forces from the expansion generate pressure within the structure which causes or assist in the movement of the corrosion products to the pores 41.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method for cathodic protection comprising:

providing steel material;

the steel material having thereon a covering material such that a part of the steel material is at least partly covered by the covering material;

forming a cathodic protection combination by:

providing an anode member defined by an anode body formed of a sacrificial anode material;

arranging the anode member at least partly in contact with the covering material for communication of ions therebetween;

and electrically connecting the anode member and the steel material so that an electrical potential is generated by galvanic action between the sacrificial anode material and the steel material which causes ions to flow through the covering material tending to inhibit corrosion of the steel material while causing corrosion of the sacrificial anode material of the anode member;

wherein the corrosion of the sacrificial anode material of the anode body acts to form corrosion products where the corrosion products have a greater volume than the sacrificial anode material of the anode body from which the corrosion products were formed thus tending to cause expansion of the anode body, the contact between the anode member and the covering material being such that the expansion tends to breakdown the covering material or the connection between the covering material and the anode member;

and restricting the expansion of the anode body and thus preventing the breakdown caused thereby by providing a reinforcing layer at or adjacent the anode member which applies restraining forces to the anode body.

2. A method for cathodic protection comprising:

providing steel material;

the steel material having thereon a covering material such that a part of the steel material is at least partly covered by the covering material;

forming a cathodic protection combination by:

providing an anode member defined by an anode body formed of a sacrificial anode material;

arranging the anode member at least partly in contact with the covering material for communication of ions therebetween;

and electrically connecting the anode member and the steel material so that an electrical potential is generated by galvanic action between the anode member and the steel material which causes ions to flow through the covering material tending to inhibit corrosion of the steel material while causing corrosion of the sacrificial anode material of the anode member;

wherein the corrosion of the sacrificial anode material of the anode member acts to form corrosion products where the corrosion products have a greater volume than the sacrificial anode material of the anode member from which the corrosion products were formed thus tending to cause expansion of the anode member, the contact between the anode member and the covering material being such that the expansion tends to breakdown the covering material or the connection between the covering material and the anode member;

and causing restraining forces on the anode member tending to restrict the expansion and the breakdown caused thereby by providing a reinforcing layer at or adjacent the anode member which applies said restraining forces to the anode member;

wherein the sacrificial anode material of the anode body is porous to allow expansion of the corrosion products into the pores;

wherein the reinforcing layer is located in the sacrificial anode material of the anode body at or adjacent an exterior surface thereof.

3. The method according to claim 2 wherein the reinforcing layer forms an enclosure which surrounds the anode body sufficiently so as to contain the forces within the enclosure.

4. The method according to claim 2 wherein the anode body is formed at least partly of materials which are pressed together to define the pores between pressed surfaces thereof.

5. The method according to claim 2 wherein the anode body includes admixed therewith an enhancement material for co-operating with the sacrificial anode material in enhancing the communication of ions between the covering material and the anode material, which enhancement material is bound into the sacrificial anode material of the solid anode body so as to be carried thereby.

6. A method for cathodic protection comprising:

providing steel material;

the steel material having thereon a covering material such that a part of the steel material is at least partly covered by the covering material;

forming a cathodic protection combination by:

providing an anode member including an anode body formed of a sacrificial anode material and an exterior layer on the anode body of a mortar coating material which is separate from the covering material;

arranging the anode member at least partly in contact with the covering material for communication of ions therebetween;

and electrically connecting the anode member and the steel material so that an electrical potential is generated by galvanic action between the anode member and the steel material which causes ions to flow through the covering material tending to inhibit corrosion of the steel material while causing corrosion of the sacrificial anode material of the anode member;

wherein the corrosion of the sacrificial anode material of the anode member acts to form corrosion products where the corrosion products have a greater volume than the sacrificial anode material of the anode member from which the corrosion products were formed thus tending to cause expansion of the anode member, the contact between the anode member and the covering material being such that the expansion tends to breakdown the covering material or the connection between the covering material and the anode member;

and causing restraining forces on the anode member tending to restrict the expansion and the breakdown caused thereby by providing a reinforcing layer at or adjacent the anode member which applies said restraining forces to the anode member;

wherein the reinforcing layer is located at or within an exterior surface of the mortar coating material of, the anode member.

7. The method according to claim 3 wherein the reinforcing layer forms an enclosure which surrounds the anode member sufficiently so as to contain the forces within the enclosure.

8. A method for cathodic protection comprising:

providing steel material;

the steel material having thereon a covering material such that a part of the steel material is at least partly covered by the covering material;

forming a cathodic protection combination by:

providing an anode member including an anode body formed of a sacrificial anode material;

arranging the anode member embedded within the covering material for communication of ions therebetween;

and electrically connecting the anode member and the steel material so that an electrical potential between the anode member and the steel material causes ions to flow through the covering material tending to inhibit corrosion of the steel material while causing corrosion of the sacrificial anode material of the anode member;

wherein the corrosion of the sacrificial anode material of the anode member acts to form corrosion products where the corrosion products have a greater volume than the sacrificial anode material of the anode member from which the corrosion products were formed thus tending to cause expansion of the anode member, the contact between the anode member and the covering material being such that the expansion tends to breakdown the covering material or the connection between the covering material and the anode member;

and causing restraining forces on the anode member tending to restrict the expansion and the breakdown caused thereby by providing a reinforcing layer at or adjacent the anode member which applies said restraining forces to the anode member;

wherein the reinforcing layer is located within an exterior surface of the covering material at a location therein spaced from the embedded anode member and from the exterior surface so that the covering material includes positions thereof located between the reinforcing layer and the anode member and between the reinforcing layer and the exterior surface.

9. The method according to claim 8 wherein the reinforcing layer has openings therein sufficient to allow the covering material, when in an un-set condition, to pass through the openings.

10. The method according to claim 8 wherein the anode member comprises an electrically conductive array which is at least partly formed by said anode material and which is arranged to follow substantially the shape of the exterior surface of the covering material.

11. The method according to claim 10 wherein the covering material is applied as a cladding of an additional layer onto an existing structure with the array being buried within the additional layer and the reinforcing layer being arranged over the array.

12. The method according to claim 11 wherein the existing structure is a column with the array being cylindrical and surrounding the existing column and the reinforcing layer forming a cylindrical layer over the array.

13. The method according to claim 11 wherein the anode member and the reinforcing layer are located within the additional layer of covering material and are maintained spaced from the exterior surface and from the existing column, during setting of the additional layer, by spacer members.

14. The method according to claim 11 wherein the additional layer of covering material is contained during setting in a flexible cylindrical form.

15. An anode member for cathodic protection of steel material in a covering material where at least a part of the steel material is at least partly covered by the covering material, the anode member comprising:

an anode body at least partly formed from a sacrificial anode material arranged such that an electrical potential is generated by galvanic action between the anode member and the steel material so as to cause ions to flow through the covering material tending to inhibit corrosion of the steel material while causing corrosion of the anode member;

the anode body being arranged for electrical connection to the steel material;

wherein the corrosion of the anode body acts to form corrosion products where the corrosion products have a greater volume than that part of the anode body from which the corrosion products were formed thus tending to cause expansion of the anode body;

wherein the sacrificial anode material of the anode body is porous to allow expansion of the corrosion products into the pores;

and a reinforcing layer located in the sacrificial anode material at or adjacent an external surface of the anode member so as to cause restraining forces on the anode body tending to restrict the expansion.

16. The anode member according to claim 15 wherein the reinforcing layer forms an enclosure which surrounds the anode body sufficiently so as to contain the forces within the enclosure.

17. The anode member according to claim 15 wherein the reinforcing layer is a mat having openings therethrough to allow communication of ions within the material through the openings.

18. The anode member according to claim 15 wherein the reinforcing layer has fibrous reinforcement.

19. The anode member according to claim 15 wherein the anode body is porous to allow expansion of the corrosion products into the pores such that the forces provided by the reinforcing layer act to assist in directing the corrosion products into the pores.

20. The anode member according to claim 19 wherein the anode body is formed at least partly of materials which are pressed together to define the pores between pressed surfaces thereof.

21. The anode member according to claim 15 the anode body includes admixed therewith an enhancement material for co-operating with the sacrificial anode material in enhancing the communication of ions between the covering material and the anode material, which enhancement material is bound into the sacrificial anode material of the solid anode member so as to be carried thereby.

22. An anode member for cathodic protection of steel material in a covering material where at least a part of the steel material is at least partly covered by the covering material, the anode member comprising:

an anode body at least partly formed from a sacrificial anode material arranged such that an electrical potential is generated by galvanic action between the anode member and the steel material so as to cause ions to flow through the covering material tending to inhibit corrosion of the steel material while causing corrosion of the anode member;

the anode body being arranged for electrical connection to the steel material;

wherein the corrosion of the anode body acts to form corrosion products where the corrosion products have a greater volume than that part of the anode body from which the corrosion products were formed thus tending to cause expansion of the anode body;

an exterior layer on the anode body of a mortar coating material;

and a reinforcing layer located at or within an exterior surface of the mortar coating material so as to cause restraining forces on the anode body tending to restrict the expansion.

23. The anode member according to claim 22 wherein the reinforcing layer forms an enclosure which surrounds the exterior layer sufficiently so as to contain the forces within the enclosure.

24. The anode member according to claim 22 wherein the reinforcing layer is a mat having openings therethrough to allow communication of ions within the material through the openings.

25. The anode member according to claim 22 wherein the reinforcing layer has fibrous reinforcement.

* * * * *